US006631663B1

(12) United States Patent
Hutzenlaub

(10) Patent No.: US 6,631,663 B1
(45) Date of Patent: Oct. 14, 2003

(54) LONGITUDINAL CUTTING DEVICE FOR A WINDING MACHINE

(75) Inventor: Armin Hutzenlaub, Wiehl (DE)

(73) Assignee: Kampf GmbH & Co. Maschinenfabrik, Wiehl (DE)

( * ) Notice: Subject to any disclaimer, the term of this patent is extended or adjusted under 35 U.S.C. 154(b) by 0 days.

(21) Appl. No.: 09/623,691

(22) PCT Filed: Feb. 12, 1999

(86) PCT No.: PCT/EP99/00928

§ 371 (c)(1),
(2), (4) Date: Sep. 1, 2000

(87) PCT Pub. No.: WO99/44932

PCT Pub. Date: Sep. 10, 1999

(30) Foreign Application Priority Data

Mar. 7, 1998 (DE) ..... 198 09 954

(51) Int. Cl.[7] ..... B26D 1/24
(52) U.S. Cl. ..... 83/496; 83/500; 83/698.41
(58) Field of Search ..... 83/100, 430, 496, 83/497, 500, 502, 505, 507, 698.41, 433, 425.2, 425, 495

(56) References Cited

U.S. PATENT DOCUMENTS

| | | | | |
|---|---|---|---|---|
| 2,717,037 A | | 9/1955 | Goodwillie | |
| 3,036,486 A | * | 5/1962 | Wilcox | 83/500 |
| 3,760,670 A | * | 9/1973 | Poran | 83/102 |
| 3,788,180 A | * | 1/1974 | Potsch et al. | 83/449 |
| 4,157,672 A | | 6/1979 | Frye | |
| 4,232,577 A | * | 11/1980 | Wallmann et al. | 83/496 |
| 4,274,319 A | | 6/1981 | Frye et al. | |
| 4,590,829 A | * | 5/1986 | Davidson et al. | 83/22 |
| 4,676,133 A | * | 6/1987 | Fujimura | 83/497 |
| 5,165,314 A | * | 11/1992 | Paulson et al. | 83/29 |
| 5,375,492 A | * | 12/1994 | Smitterberg et al. | 83/13 |
| 5,503,053 A | * | 4/1996 | Onishi et al. | 83/501 |

FOREIGN PATENT DOCUMENTS

| | | | | |
|---|---|---|---|---|
| DE | 89973 | * | 5/1896 | 83/497 |
| DE | 447854 | * | 7/1927 | 83/496 |
| DE | 1 290 038 | | 2/1969 | |
| DE | 28 36 374 A1 | | 2/1980 | |
| FR | 723266 | * | 4/1932 | 83/496 |
| GB | 1908 | * | 1/1901 | 83/497 |
| GB | 663492 | * | 12/1951 | 83/496 |
| GB | 2 045 672 A | | 11/1980 | |

* cited by examiner

*Primary Examiner*—Kenneth E. Peterson
*Assistant Examiner*—Omar Flores Sánchez
(74) *Attorney, Agent, or Firm*—Herbert Dubno; Andrew Wilford

(57) ABSTRACT

Known winding machines for winding up continuous strips of material, especially plastic strips, use longitudinal cutting devices comprising a series of upper blades (1) embodied as disk-shaped circular blades, and a series of lower blades (2) embodied as circular blades. According to the invention one lower blade (2) each is arranged on both sides of an upper blade (1), the lower blades (2) are mounted in a freely rotating manner on a carrying axle (3) and the planes of rotation (4) of the two lower blades (2) assigned to an upper blade (1) are symmetrically inclined in relation to each other and form an acute angle with said plane of rotation (5) of the upper blade (1) in such a way that the cutting edges of the two lower blades (2) move towards and away from each other during one revolution. The longitudinal cutting device provided for in the invention makes it possible to cut narrow ribbons from the strip and to convey them such that the rolls can be wound on a shared winding axle with the required distance between them.

9 Claims, 1 Drawing Sheet

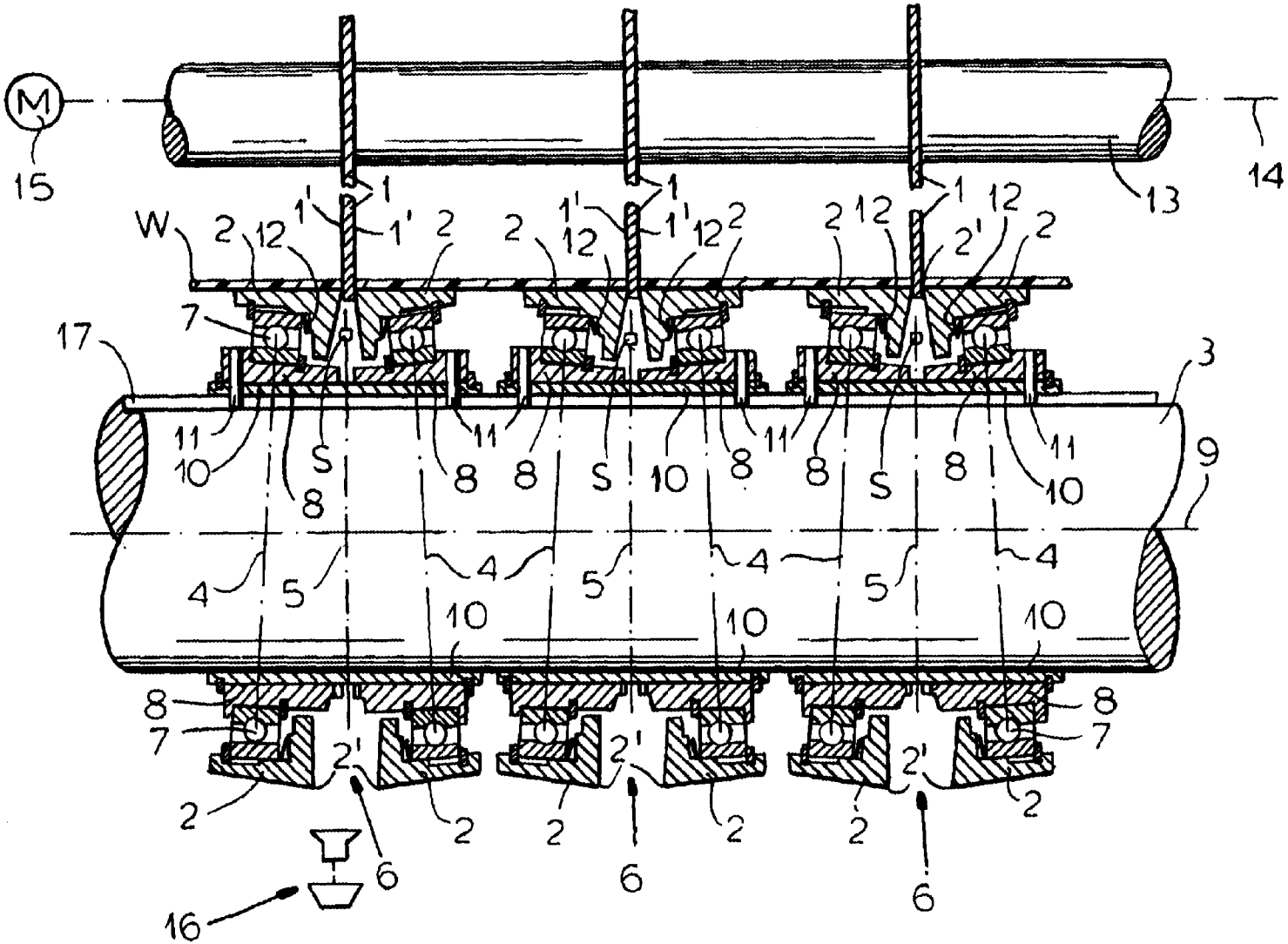
14
13
3
9
1
1'
2
2'
12
11
10
8
7
S
4
5
6
W
17
15
16

LONGITUDINAL CUTTING DEVICE FOR A WINDING MACHINE

CROSS REFERENCE TO RELATED APPLICATIONS

This application is the US national phase of PCT application PCT/EP99/00928 filed Feb. 12, 1999 with a claim to the priority of German patent application 19809954.1 itself filed Mar. 7, 1998.

FIELD OF THE INVENTION

The invention relates to a longitudinal slitter for a winding machine for winding up advancing workpiece webs, in particular plastic webs, with a row of upper blades that are formed as disk-shaped circular blades and with a row of lower blades that are formed as circular blades.

STATE OF THE ART

Winding machines known as roller cutting machines have as is known a longitudinal slitter that subdivides the workpiece web by longitudinally cutting it into individual strips that are subsequently wound up into rolls. It is necessary when winding up plastic webs that two adjacent rolls have a certain spacing from one another so that if a web is misfed it does not get caught. Any contact between two adjacent winding rolls at their ends must also be avoided so that in the event of profile variations there is no friction between two winding rolls when they grow radially differently.

In order that each roll has the necessary axial spacing from the neighboring roll, the rolls are as is known wound up on two parallel winding shafts that are spaced from each other. The individual webs are alternately fed to one of the two winding shafts so that adjacent rolls are wound up offset from one another. This makes the equipment relatively expensive since the winding machine needs two winding shafts.

In order to be able to wind up all the rolls on a common winding shaft with the necessary spacing rom one another it has been suggested to cut a small strip out of the web during the longitudinal slitting so as to hold two adjacent winding rolls at the necessary axial spacing from each other. This procedure, which simplifies the construction of the winding machine, is not acceptable able since the strip cut out between the two webs and discarded must be very narrow so that the waste is tolerable. In addition there is the problem during cutting of conducting the extremely narrow strip out of the longitudinal slitter.

OBJECT OF THE INVENTION

It is therefore an object of the invention to provide a longitudinal slitter for a winding machine that allows a strip less than 5 mm wide to be cut out of the web and carried off.

This object is attained with the features of claim 1.

The dependent claims described preferred particularly advantageous embodiments of a longitudinal slitter according to the invention.

BRIEF DESCRIPTION OF THE DRAWING

The drawing serves for describing the invention by means of a simplified illustrative embodiment.

FIG. 1 shows a section through a longitudinal slitter according to the invention.

EMBODIMENTS OF THE INVENTION

The longitudinal slitter has a row of upper blades 1 that are formed as disk-shaped circular blades. The upper blades 1 are mounted as is standard on a common shaft with transverse adjustability so that they can be set in the desired cut positions. All of the upper blades 1 are connected to a common drive, for example the common shaft is driven.

The upper blades 1 are rectangular in section so that they have two parallel end faces against which cutting edges of respective lower blades 2 can be set. Each face of an upper blade 1 thus forms with a respective lower blade 2 a pair of cutting edges that cut through the plastic web longitudinally. The two longitudinal cuts made by each upper blade 1 excise a narrow strip from the web having a width that is equal to the thickness of the upper blades 1. The thickness of the upper blades 1 is less than 5 mm, preferably 1 mm to 2 mm, in order to minimize the loss of the web material caused by cutting out the strip while maintaining the blades 1 stable.

All of the lower blades 2 are freely rotatably on a stationary support shaft 3. When in use they are each spring biased against a respective face of the respective upper blade 1 and are thus driven by it.

As shown in FIG. 1, each upper blade 1 is associated with two lower blades 2. The lower blades 2 are also circular blades that are so constructed and so mounted on the support shaft 3 that their rotation planes 4 form an acute angle to rotation planes 5 of the upper blades 1. The rotations planes 4 of the two lower blades 2 associated with an upper blade 1 are inclined symmetrically to each other so that their cutting edges move toward and then away from each other during one revolution. With the very small gap between each pair of lower blades 2 shown at the top in FIG. 1, the two cutting edges each contact a respective face of the upper blade 1. Diametrally opposite each upper blade 1 the two cutting edges of the respective lower blades have a maximum spacing from each other as shown on the bottom in FIG. 1. This large spacing of the cutting edges produces between each pair of lower blades 2 a wide gap 6 which makes it possible to conduct away the cut-out strip in this region. Preferably this is done by a suction device which vacuums the cut-out strip from the region between the two lower blades 2.

Preferably the lower blades are so-called cup blades that are of frustoconical shape so that the wide edge of the frustocone forms the cutting edge. Each lower blade 2 is rotatably mounted via a roller bearing 7 on a support sleeve 8. The outer surfaces of the support sleeves 8 are cylindrical and inclined to an axis 9 of the support shaft 3. Thus each outer race of each bearing 7 rotates with the lower blade 2 about an axis that forms a small acute angle with a central axis 9 of the support shaft 3. The inner surface of each support sleeve 8 extends parallel to the surface of the support shaft 3. The two support sleeves 8 of each pair of lower blades are fixed to a connecting sleeve 10 that is slidably mounted on the support shaft 8. The angular position of each connecting sleeve 10 with the two support sleeves 8 fixed thereon is set by means of two lateral fixing pins 10 that extend through the two sleeves 8 and 10 and engage in an axial groove of the support shaft 3. Each connecting sleeve 10 with the parts fixed on it is automatically positioned axially in the cutting position by the lower blades 2 that are oriented by engagement with the axially fixed upper blade 1.

The lower blades 2 are each limitedly displaceable on the respective bearings 7 parallel to the axis 9 and the inner flange of each lower blade 2 is engaged by a spring 12 that presses its cutting edge against the respective upper blade 1. The cutting edge of each lower blade 2 is thus spring-biased against the respective upper blade 1.

The outer surfaces of the lower blades 2 are constructed so that when cutting they form a surface parallel to the web and against which the web is supported over its entire width during slitting. As shown in the top of FIG. 1 the outer surfaces of the lower blades 2 form at the point of contact with the upper blades 1 a straight line that extends parallel to a rotation axis of the upper blades 1 and thus at a right angle to their side faces.

In order that before slitting begins the upper blades 1 can be brought into their cutting position between the respective lower blades 2, the support shaft 3 is rotatable through about 180° about its axis 9. Such rotation of the support shaft 3 through about 180° moves the portion of the support sleeves 8 where the blades 2 are most widely spaced to the upper blade 1. The upper blades 1 can then be moved from above into the wide gap 6 between the two lower blades 2. Thereafter the support shaft 3 is again rotated back into the FIG. 1 cutting position and is held in this position. On such movement the cutting edges of the blades 2 are automatically brought into contact with the respective upper blades 1.

What is claimed is:

1. A longitudinal slitter for a web, the slitter comprising:

a support shaft extending along an axis parallel to and below the web and transverse to a displacement direction of the web;

a plurality of axially spaced circular disk-shaped upper blades above the shaft and each having a pair of parallel faces extending perpendicular to the axis;

respective pairs of lower blades spaced axially on the shaft and rotatable on the shaft about the axis with the blades of each pair flanking a respective one of the upper blades, each lower blade having an outer surface turned toward a respective face of the respective upper blade and forming a cutting edge engageable with the respective face of the respective upper blade and lying in a plane forming an acute angle with the axis, the planes of each pair of lower blades diverging symmetrically in a cutting position downward away from the respective upper blade, the lower-blade cutting edges contacting the respective upper-blade faces along a straight line extending substantially parallel to the support-shaft axis; and means for rotating the blades with the web between them and thereby cutting from the web with each upper blade a strip having a thickness equal to an axial spacing between the faces of the respective upper blade.

2. The longitudinal web slitter defined in claim 1 wherein the axial spacing between the faces of each upper blade is at most 5 mm.

3. The longitudinal web slitter defined in claim 1 wherein the outer surfaces are frustoconical.

4. The longitudinal web slitter defined in claim 1 further comprising respective spring means biasing the cutting edges of the lower blades axially against the faces of the respective upper blades.

5. The longitudinal web slitter defined in claim 1, further comprising means for aspirating the strip downward from between the lower blades.

6. The longitudinal web slitter defined in claim 1 wherein the means is connected to the upper blades and drives them directly, the lower blades being driven by contact with the upper blades.

7. A longitudinal slitter for a web, the slitter comprising:

a support shaft extending along an axis parallel to and below the web and transverse to a displacement direction of the web;

a plurality of axially spaced circular disk-shaped upper blades above the shaft and each having a pair of parallel faces extending perpendicular to the axis;

respective pairs of lower blades spaced axially on the shaft and rotatable about the axis with the blades of each pair flanking a respective one of the upper blades, each lower blade having an outer surface turned toward a respective face of the respective upper blade and forming a cutting edge engageable with the respective face of the respective upper blade and lying in a plane forming an acute angle with the axis the planes of each pair of lower blades diverging symmetrically in a cutting position downward away from the respective upper blade, the lower-blade cutting edges contacting the respective upper-blade faces along a line extending substantially parallel to the support-shaft axis;

means for rotating the blades with the web between them and thereby cutting from the web with each upper blade a strip having a thickness equal to an axial spacing between the faces of the respective upper blade; and respective bearings carrying the lower blades on the shaft and defining blade planes parallel to the respective cutting edge planes.

8. The longitudinal web slitter defined in claim 7 wherein the lower blades are spaced more widely apart at a region diametrally across the axis from the upper blades than at the upper blades, the slitter further comprising means for rotating the shaft and bearings through about 180° and thereby displacing the region into alignment with the upper blades.

9. A longitudinal slitter for a web, the slitter comprising:

a support shaft extending along an axis parallel to and below the web and transverse to a displacement direction of the web;

a plurality of axially spaced circular disk-shaped upper blades above the shaft and each having a pair of parallel faces extending perpendicular to the axis;

respective pairs of lower blades spaced axially on the shaft and rotatable about the axis with the blades of each pair flanking a respective one of the upper blades, each lower blade having an outer surface turned toward a respective face of the respective upper blade and forming a cutting edge engageable with the respective face of the respective upper blade and lying in a plane forming an acute angle with the axis, the planes of each pair of lower blades diverging symmetrically in a cutting position downward away from the respective upper blade, the lower-blade cutting edges contacting the respective upper-blade faces along a line extending substantially parallel to the support-shaft axis, the lower blades having outer surfaces forming along the line a surface parallel to the axis; and means for rotating the blades with the web between them and thereby cutting from the web with each upper blade a strip having a thickness equal to an axial spacing between the faces of the respective upper blade.

* * * * *